US009404397B2

(12) United States Patent
Verner et al.

(10) Patent No.: US 9,404,397 B2
(45) Date of Patent: Aug. 2, 2016

(54) ENGINE VALVE POSITION SENSING SYSTEMS AND METHODS

(71) Applicant: GM GLOBAL TECHNOLOGY OPERATIONS LLC, Detroit, MI (US)

(72) Inventors: Douglas R. Verner, Sterling Heights, MI (US); Sanjeev M. Naik, Troy, MI (US); Donovan L. Dibble, Utica, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 166 days.

(21) Appl. No.: 13/786,861

(22) Filed: Mar. 6, 2013

(65) Prior Publication Data

US 2014/0251242 A1 Sep. 11, 2014

(51) Int. Cl.

| | |
|---|---|
| ***F01L 9/04*** | (2006.01) |
| ***F01L 1/34*** | (2006.01) |
| ***F01L 13/00*** | (2006.01) |
| *F02D 41/22* | (2006.01) |
| *F01L 1/18* | (2006.01) |

(52) U.S. Cl.

CPC ..... *F01L 1/34* (2013.01); *F01L 13/0036* (2013.01); *F01L 1/185* (2013.01); *F01L 2800/11* (2013.01); *F01L 2820/045* (2013.01); *F02D 41/221* (2013.01)

(58) Field of Classification Search

USPC ..... 123/90.15, 90.16, 90.39–90.59; 324/207.2

See application file for complete search history.

(56) References Cited

U.S. PATENT DOCUMENTS

| | | | | |
|---|---|---|---|---|
| 4,914,566 | A | 4/1990 | Steutermann | |
| 5,698,778 | A * | 12/1997 | Ban et al. | 73/114.36 |
| 5,983,847 | A | 11/1999 | Miyoshi et al. | |
| 6,293,303 | B1 | 9/2001 | Mori et al. | |
| 6,305,353 | B1 * | 10/2001 | Weber et al. | 123/406.58 |
| 6,382,246 | B2 | 5/2002 | Mori et al. | |
| 7,032,549 | B1 | 4/2006 | Verner et al. | 123/90.11 |
| 7,546,827 | B1 * | 6/2009 | Wade et al. | 123/324 |
| 8,502,531 | B2 * | 8/2013 | Bootle et al. | 324/251 |
| 8,688,352 | B2 * | 4/2014 | Hehle et al. | 701/103 |
| 2011/0050220 | A1 | 3/2011 | Bootle et al. | |
| 2014/0158177 | A1 * | 6/2014 | Zlotnicki et al. | 136/201 |

FOREIGN PATENT DOCUMENTS

DE 3437150 A1 4/1986

* cited by examiner

*Primary Examiner* — Thomas Denion
*Assistant Examiner* — Daniel Bernstein

(57) ABSTRACT

A vehicle system includes a position sensor, a current supply module, and a mode indicator module. The position sensor includes: an electromagnet (EM) that generates a magnetic field proximate to one of an intake valve and an exhaust valve of an engine; and a Hall-effect sensor that generates a position signal indicating a position of the one of the intake valve and the exhaust valve based on the magnetic field. The current supply module supplies current to the EM. The mode indicator module indicates whether the one of the intake valve and the exhaust valve is being actuated in a low lift mode or a high lift mode based on the position signal.

20 Claims, 6 Drawing Sheets

ENGINE VALVE POSITION SENSING SYSTEMS AND METHODS

FIELD

The present disclosure relates to internal combustion engines and more particularly to systems and methods for sensing position of engine valves.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

Vehicles include an internal combustion engine that generates drive torque. More specifically, an intake valve is selectively opened to draw air into a cylinder of the engine. The air mixes with fuel to form an air/fuel mixture that is combusted within the cylinder. The air/fuel mixture is compressed and combusted to drive a piston within the cylinder. An exhaust valve selectively opens to allow the exhaust gas resulting from combustion to exit the cylinder.

A rotating camshaft regulates the opening and closing of the intake and/or exhaust valves. The camshaft includes cam lobes that are fixed to and rotate with the camshaft. The geometric profile of a cam lobe generally controls the period that the valve is open (duration) and the magnitude or degree to which the valve opens (lift).

Variable valve actuation (WA), also called variable valve lift (VVL) improves fuel economy, engine efficiency, and/or performance by modifying valve lift and duration as a function of engine operating conditions. Two-step WA systems include VVL mechanisms, such as hydraulically-controlled, switchable roller finger followers (SRFFs). A SRFF associated with a valve (e.g., an intake or an exhaust valve) allows the valve to be lifted in two discrete modes: a low lift mode and a high lift mode. Generally, the valve lift associated with the high lift mode is greater than the valve lift associated with the low lift mode.

SUMMARY

A vehicle system includes a position sensor, a current supply module, and a mode indicator module. The position sensor includes: an electromagnet (EM) that generates a magnetic field proximate to one of an intake valve and an exhaust valve of an engine; and a Hall-effect sensor that generates a position signal indicating a position of the one of the intake valve and the exhaust valve based on the magnetic field. The current supply module supplies current to the EM. The mode indicator module indicates whether the one of the intake valve and the exhaust valve is being actuated in a low lift mode or a high lift mode based on the position signal.

In further features, the current supply module generates a periodic signal in the current.

In still further features, the Hall-effect sensor transitions the position signal from a first state to a second state when the magnetic field is greater than a predetermined value and transitions the position signal from the second state to the first state when the magnetic field is less than the predetermined value.

In yet further features, the mode indicator module indicates whether the one of the intake valve and the exhaust valve is being actuated in the low lift mode or the high lift mode based on whether a period that the position signal is in the first state is greater than a predetermined period.

In further features, the mode indicator module indicates whether the one of the intake valve and the exhaust valve is being actuated in the low lift mode or the high lift mode based on whether a period that the position signal is in the first state is less than a predetermined period.

In still further features, the mode indicator module indicates whether the one of the intake valve and the exhaust valve is being actuated in the low lift mode or the high lift mode based on whether a period that the position signal is in the second state is greater than a predetermined period.

In yet further features, the mode indicator module indicates whether the one of the intake valve and the exhaust valve is being actuated in the low lift mode or the high lift mode based on whether a period that the position signal is in the second state is less than a predetermined period.

In further features, the system further includes a fault diagnostic module that selectively diagnoses a fault in a variable valve lift (VVL) mechanism of the one of the intake valve and the exhaust valve based on the indication of whether the one of the intake valve and the exhaust valve is being actuated in the low lift mode or the high lift mode.

In still further features, the system further includes a valve control module that selectively commands actuation of the one of the intake valve and the exhaust valve in the low lift mode based on a torque request. The fault diagnostic module diagnoses a fault in the VVL mechanism when the mode indicator module indicates that the one of the intake valve and the exhaust valve is being actuated in the high lift mode a predetermined period after generation of the command.

In yet further features, the system further includes a valve control module that selectively commands actuation of the one of the intake valve and the exhaust valve in the high lift mode based on a torque request. The fault diagnostic module diagnoses a fault in the VVL mechanism when the mode indicator module indicates that the one of the intake valve and the exhaust valve is being actuated in the low lift mode a predetermined period after generation of the command.

A method for a vehicle, includes: generating, using an electromagnet (EM) of a position sensor, a magnetic field proximate to one of an intake valve and an exhaust valve of an engine; and generating, using a Hall-effect sensor of the position sensor, a position signal indicating a position of the one of the intake valve and the exhaust valve based on the magnetic field. The method further includes: supplying current to the EM; and indicating whether the one of the intake valve and the exhaust valve is being actuated in a low lift mode or a high lift mode based on the position signal.

In further features, the method further includes generating a periodic signal in the current.

In still further features, the method further includes: transitioning, using the Hall-effect sensor, the position signal from a first state to a second state when the magnetic field is greater than a predetermined value; and transitioning, using the Hall-effect sensor, the position signal from the second state to the first state when the magnetic field is less than the predetermined value.

In yet further features, the method further includes indicating whether the one of the intake valve and the exhaust valve is being actuated in the low lift mode or the high lift mode based on whether a period that the position signal is in the first state is greater than a predetermined period.

In further features, the method further includes indicating whether the one of the intake valve and the exhaust valve is being actuated in the low lift mode or the high lift mode based on whether a period that the position signal is in the first state is less than a predetermined period.

In still further features, the method further includes indicating whether the one of the intake valve and the exhaust valve is being actuated in the low lift mode or the high lift mode based on whether a period that the position signal is in the second state is greater than a predetermined period.

In yet further features, the method further includes indicating whether the one of the intake valve and the exhaust valve is being actuated in the low lift mode or the high lift mode based on whether a period that the position signal is in the second state is less than a predetermined period.

In further features, the method further includes selectively diagnosing a fault in a variable valve lift (VVL) mechanism of the one of the intake valve and the exhaust valve based on the indication of whether the one of the intake valve and the exhaust valve is being actuated in the low lift mode or the high lift mode.

In still further features, the method further includes: selectively commanding actuation of the one of the intake valve and the exhaust valve in the low lift mode based on a torque request; and diagnosing a fault in the VVL mechanism when the one of the intake valve and the exhaust valve is being actuated in the high lift mode a predetermined period after generation of the command.

In yet further features, the method further includes: selectively commanding actuation of the one of the intake valve and the exhaust valve in the high lift mode based on a torque request; and diagnosing a fault in the VVL mechanism when the one of the intake valve and the exhaust valve is being actuated in the low lift mode a predetermined period after generation of the command.

Further areas of applicability of the present disclosure will become apparent from the detailed description provided hereinafter. It should be understood that the detailed description and specific examples are intended for purposes of illustration only and are not intended to limit the scope of the disclosure.

BRIEF DESCRIPTION OF THE DRAWINGS

The present disclosure will become more fully understood from the detailed description and the accompanying drawings, wherein.

DETAILED DESCRIPTION

An engine control module controls engine actuators based on a requested amount of torque. Engine actuators may include, for example, a throttle valve, a fuel system, an ignition system, camshaft phasers, a variable valve lift (VVL) system, and other types of engine actuators. A VVL mechanism of the VVL system controls actuation of a valve of an engine, such as an intake valve.

Based on the requested amount of torque, the ECM may command operation of the VVL mechanism in a low lift mode or in a high lift mode. When operating in the low lift mode, the VVL mechanism controls opening and closing of the valve based on a geometric profile of a low lift cam lobe that rotates with a camshaft. When operating in the high lift mode, the VVL mechanism controls opening and closing of the valve based on a geometric profile of a high lift cam lobe that rotates with the camshaft. For example, the ECM may command operation of the VVL mechanism in the high lift mode when the requested amount of torque is greater than a predetermined torque.

A position sensor that is associated with the valve includes an electromagnet (EM) and a Hall-effect sensor. The EM generates a magnetic field proximate to a portion of the valve, such as within 50 millimeters of the valve or within another suitable distance from the valve. The EM may be smaller than a rare earth magnet that produces an equal or similar magnetic field. Additionally, EM may cost less than a rare earth magnet that produces an equal or similar magnetic field.

The magnetic field changes as the valve is actuated. The Hall-effect sensor generates a position signal that indicates whether the valve is closed or open based on the magnetic field. The position signal changes based on whether the VVL mechanism is operating in the high lift mode or the low lift mode. For example, a period that the position signal indicates that the valve is open may increase during operation in the high lift mode relative to operation in the low lift mode.

The ECM determines whether the VVL mechanism is operating in the low lift mode or the high lift mode based on the position signal. Whether the VVL mechanism is operating in the low lift mode or the high lift mode may be used, for example, by the ECM to determine whether a fault is present in the VVL mechanism.

Figure 1A:
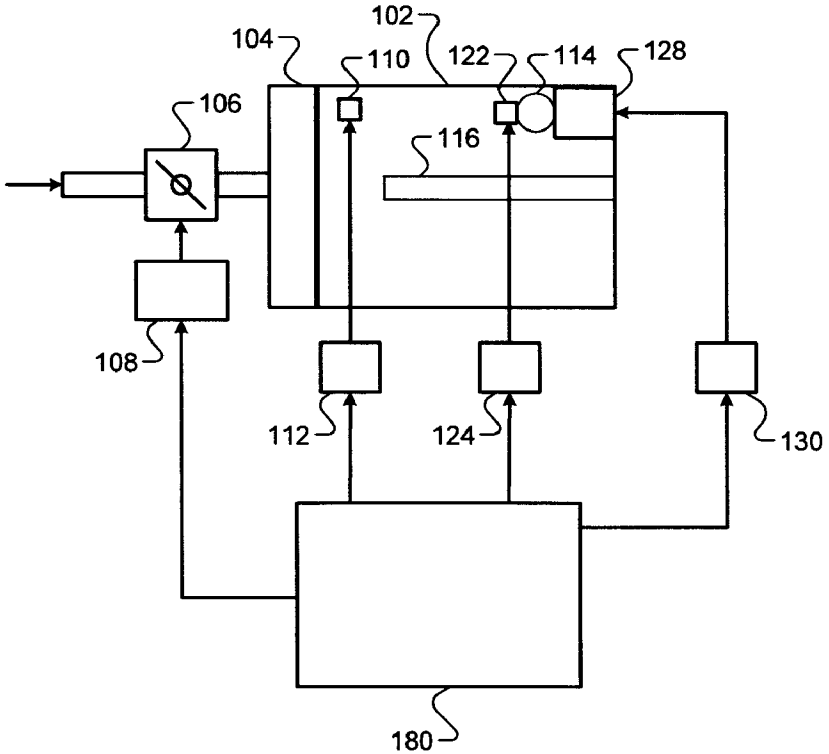
FIGS. 1A is a functional block diagram of an example control system according to the present disclosure.

Referring now to FIG. 1A, a functional block diagram of an example engine control system is presented. An engine 102 generates torque for a vehicle. Air is drawn into the engine 102 through an intake manifold 104. Airflow into the intake manifold 104 may be varied by a throttle valve 106. A throttle actuator module 108 (e.g., an electronic throttle controller) controls opening of the throttle valve 106. One or more fuel injectors, such as fuel injector 110, mix fuel with the air to form a combustible air/fuel mixture. A fuel actuator module 112 controls the fuel injector(s).

A cylinder 114 includes a piston (not shown) that is coupled to a crankshaft 116. Although the engine 102 is depicted as including only the cylinder 114, the engine 102 may include more than one cylinder. One combustion cycle of the cylinder 114 may include four strokes: an intake stroke, a compression stroke, an expansion stroke, and an exhaust stroke. One engine cycle includes each of the cylinders undergoing one combustion cycle.

Figure 1B:
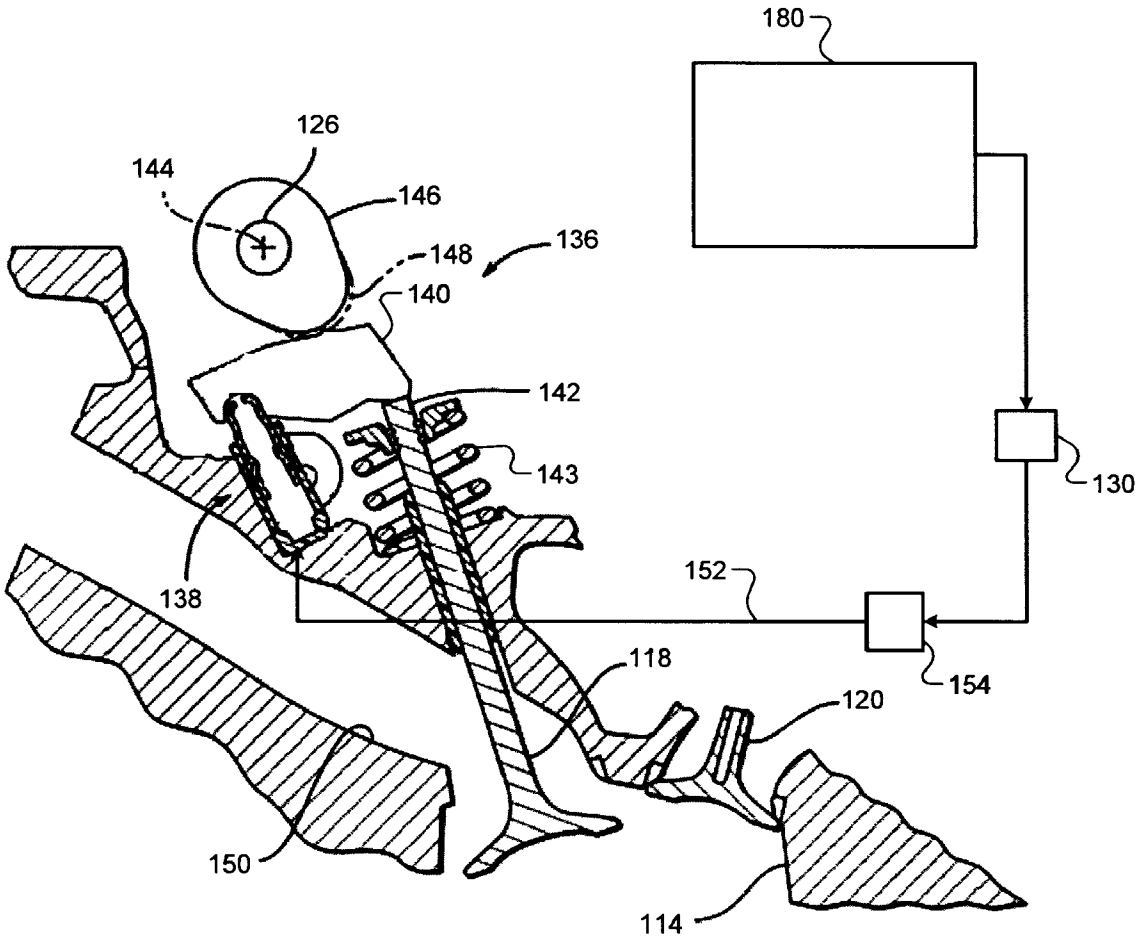
FIG. 1B is a diagram of an example variable valve lift (VVL) system according to the present disclosure.

FIG. 1B is a diagram of an example variable valve lift (VVL) system. Referring now to FIGS. 1A and 1B, during the intake stroke, the piston is lowered to a bottom most position, and air and fuel may be provided to the cylinder 114. The bottom most position may be referred to as a bottom dead center (BDC) position. Air enters the cylinder 114 through one or more intake valves, such as intake valve 118. One or more exhaust valves, such as exhaust valve 120, are also associated with the cylinder 114. For purposes of discussion only, only the intake valve 118 and the exhaust valve 120 will be discussed.

During the compression stroke, the crankshaft 116 drives the piston toward a top most position. The intake valve 118 and the exhaust valve 120 may both be closed during the compression stroke, and the piston compresses the air/fuel mixture within the cylinder 114. The top most position may be referred to as a top dead center (TDC) position. A spark plug 122 may ignite the air/fuel mixture in various types of engines. A spark actuator module 124 controls the spark plug 122.

Combustion of the air/fuel mixture drives the piston back toward the BDC position during the expansion stroke, thereby rotatably driving the crankshaft 116. The rotational force (i.e., torque) may be a source of compressive force for a compression stroke of a combustion cycle of a next cylinder in a predetermined firing order. Exhaust resulting from the combustion of the air/fuel mixture is expelled from the cylinder 114 during the exhaust stroke. The exhaust is expelled from the cylinder 114 via the exhaust valve 120.

The timing of opening and closing of the intake valve 118 is regulated by an intake camshaft 126. An intake camshaft, such as the intake camshaft 126, may be provided for each bank of cylinders of the engine 102. The timing of opening and closing of the exhaust valve 120 is regulated by an exhaust camshaft (not shown). An exhaust camshaft may be provided for each bank of cylinders of the engine 102. Rotation of the intake camshaft(s) and the exhaust camshaft(s) is generally driven by rotation of the crankshaft 116, such as by a belt or a chain.

A cam phaser regulates rotation of an associated camshaft. For example only, intake cam phaser 128 (FIG. 1A) may regulate rotation of the intake camshaft 126 (FIG. 1B). The intake cam phaser 128 may adjust the rotation of the intake camshaft 126, for example, with respect to rotation of the crankshaft 116. For example only, the intake cam phaser 128 may retard or advance rotation of the intake camshaft 126, thereby changing the opening and closing timing of the intake valve 118. While not shown, an exhaust cam phaser may regulate rotation of the exhaust camshaft. Adjusting the rotation of a camshaft with respect to rotation of the crankshaft 116 may be referred to as camshaft phasing.

A phaser actuator module 130 controls the intake cam phaser 128. The phaser actuator module 130 or another phaser actuator module may control operation of other cam phasers. The intake cam phaser 128 may be, for example, electrically or hydraulically actuated. A hydraulically actuated cam phaser actuates based on pressure of a hydraulic fluid (e.g., oil) supplied to the cam phaser.

A variable valve lift (VVL) mechanism 136 (FIG. 1B) controls actuation of the intake valve 118. For example only, the VVL mechanism 136 may include a switchable roller finger follower (SRFF) mechanism. While the VVL mechanism 136 is shown and will be discussed as a SRFF, the VVL mechanism 136 may include other types of valve lift mechanisms that enable an associated valve to be lifted to two or more discrete lift positions. Further, while the VVL mechanism 136 is shown and will be discussed as being associated with the intake valve 118, the VVL mechanism 136 or another VVL mechanism may be implemented similarly for the exhaust valve 120. For example only, one VVL mechanism may be provided for each intake valve and one VVL mechanism may be provided for each exhaust valve of a cylinder.

The VVL mechanism 136 includes a lift adjuster 138 and a cam follower 140. The cam follower 140 is in mechanical contact with a valve stem 142 of the intake valve 118. A biasing device 143 biases the valve stem 142 into contact with the cam follower 140. The cam follower 140 is also in mechanical contact with the intake camshaft 126 and the lift adjuster 138.

The intake camshaft 126 rotates about a camshaft axis 144. The intake camshaft 126 includes a plurality of cam lobes including low lift cam lobes, such as low lift cam lobe 146, and high lift cam lobes, such as high lift cam lobe 148. For example only, the intake camshaft 126 may include one low lift cam lobe and one high lift cam lobe for each valve of a cylinder.

The low and high lift cam lobes 146 and 148 rotate with the intake camshaft 126. Air may flow into the cylinder 114 through an inlet passage 150 when the intake valve 118 is open. Airflow into the cylinder 114 may be blocked when the intake valve 118 is closed. The intake valve 118 is selectively lifted (i.e., opened) and lowered (i.e., closed) via the intake camshaft 126. More specifically, the intake valve 118 is opened and closed by the low lift cam lobe 146 or the high lift cam lobe 148.

A cam lobe contacting the cam follower 140 applies a force to the cam follower 140 in the direction of the valve stem 142 and the lift adjuster 138. The lift adjuster 138 is collapsible to allow the intake valve 118 to be opened to two different positions, a low lift position and high lift position. The extent to which the lift adjuster 138 is collapsible is based on pressure of a hydraulic fluid 152 provided to the lift adjuster 138. Generally, the extent to which the lift adjuster 138 is collapsible decreases as the pressure of the hydraulic fluid 152 increases and vice versa. As the collapsibility of the lift adjuster 138 decreases, the cam follower 140 applies more of the force of a cam lobe to the valve stem 142, thereby opening the intake valve 118 to a greater extent and vice versa.

The hydraulic fluid 152 may be provided to the lift adjuster 138 at a predetermined low lift pressure and at a predetermined high lift pressure to regulate opening of the intake valve 118 in a low lift mode and a high lift mode, respectively. The predetermined high lift pressure is greater than the predetermined low lift pressure. A fluid control valve 154 regulates the flow of the hydraulic fluid 152 to the lift adjuster 138. The phaser actuator module 130 may control the fluid control valve 154. The fluid control valve 154 may also be referred to as an oil control valve (OCV).

To summarize, during operation in the low lift mode, the low lift cam lobe 146 causes the VVL mechanism 136 to pivot in accordance with the geometry of the low lift cam lobe 146. The pivoting of the VVL mechanism 136 caused by the low lift cam lobe 146 opens the intake valve 118 a first predetermined amount. During operation in the high lift mode, the high lift cam lobe 148 causes the VVL mechanism 136 to pivot in accordance with the geometry of the high lift cam lobe 148. The pivoting of the VVL mechanism 136 caused by the high lift cam lobe 148 opens the intake valve 118 a second predetermined amount. The second predetermined amount is greater than the first predetermined amount.

An engine control module (ECM) 180 regulates operation of the engine 102 to achieve a requested amount of torque. For example, the ECM 180 may regulate opening of the throttle valve 106, amount and timing of fuel injection, spark timing, camshaft phasing, lift mode, and other engine operating parameters based on the requested amount of torque.

Figure 2:
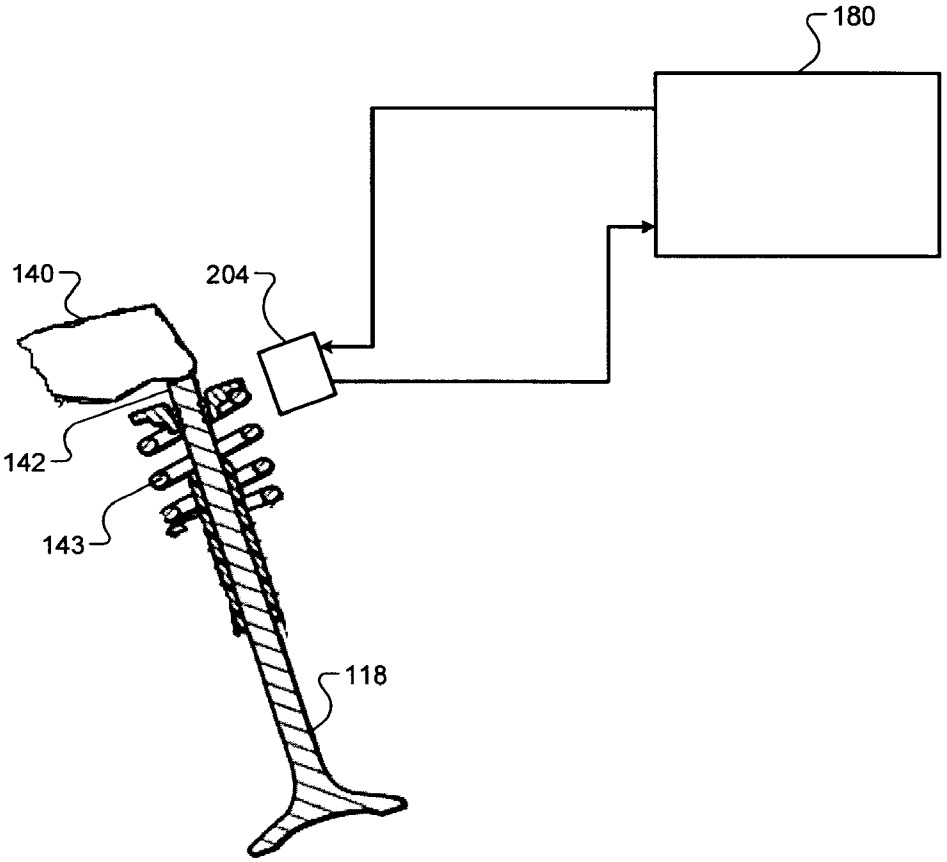
FIG. 2 is another example diagram of the VVL system according to the present disclosure.

Referring now to FIG. 2, another example diagram of a VVL system is presented. A position sensor 204 is provided with the intake valve 118. While only the position sensor 204 is shown and will be discussed, one position sensor mechanism may be provided for each valve of the engine 102 that can be actuated in two or more different lift modes. The position sensor 204 receives current from the ECM 180 and generates a position signal based on the position of the intake valve 118. Based on the position signal, the ECM 180 determines whether the intake valve 118 is being operated in the low lift state or the high lift state.

Figure 3:
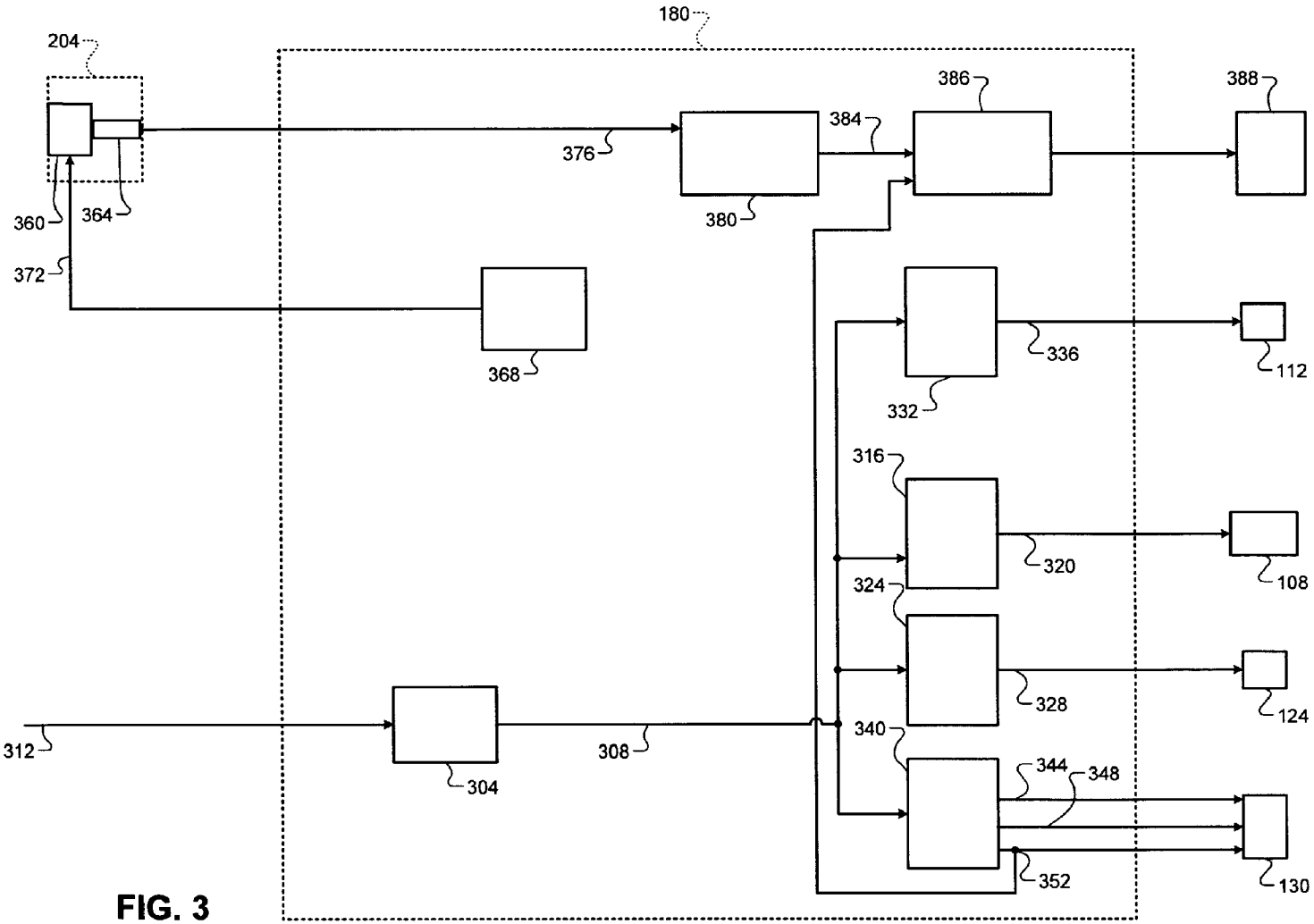
FIG. 3 is a functional block diagram of an example system including a position sensor and an engine control module according to the present disclosure.

Referring now to FIG. 3, a functional block diagram of an example system including the position sensor 204 and the ECM 180 is presented. A torque request module 304 may determine a torque request 308 based on one or more driver inputs 312, such as an accelerator pedal position, a brake pedal position, a cruise control input, and/or one or more other suitable driver inputs. The torque request module 304 may determine the torque request 308 additionally or alternatively based on one or more other torque requests, such as torque requests generated by the ECM 180 and/or torque requests received from other modules of the vehicle, such as a transmission control module, a hybrid control module, a chassis control module, etc.

One or more engine actuators may be controlled based on the torque request 308 and/or one or more other parameters. For example, a throttle control module 316 may determine a target throttle opening 320 based on the torque request 308. The throttle actuator module 108 may adjust opening of the throttle valve 106 based on the target throttle opening 320.

A spark control module 324 may determine a target spark timing 328 based on the torque request 308. The spark actuator module 124 may generate spark based on the target spark timing 328. A fuel control module 332 may determine one or more target fueling parameters 336 based on the torque request 308. For example, the target fueling parameters 336 may include fuel injection amount, number of fuel injections for injecting the amount, and timing for each of the injections. The fuel actuator module 112 may inject fuel based on the target fueling parameters 336.

A valve control module 340 may determine target intake and exhaust cam phaser angles 344 and 348 based on the torque request 308. The phaser actuator module 130 may regulate the intake cam phaser 128 and the exhaust cam phaser based on the target intake and exhaust cam phaser angles 344 and 348, respectively. One or more other engine actuators may be controlled based on the torque request 308.

The valve control module 340 may also determine a target lift mode 352. The target lift mode 352 may command operation in the high lift mode or operation in the low lift mode. Based on the target lift mode 352, the phaser actuator module 130 may control the fluid control valve 154 to control the pressure of fluid provided to the lift adjuster 138 and to operate the VVL mechanism 136 in the high lift mode or the low lift mode.

The position sensor 204 includes an electro magnet (EM) 360 and a Hall-effect sensor 364. A current supply module 368 supplies current 372 to the EM 360, and the EM 360 generates a magnetic field based on the current 372. Characteristics of the EM 360 and/or the current 372 may be set based on dimensions of an air gap between the position sensor 204 and a portion of the intake valve 118, the biasing member 143, a valve spring retainer, etc. For example only, with an air gap of 5 millimeters (mm) wide and a length of 9 mm, the EM 360 may include a steel core with an area of 25 $mm^2$, include a coil with 360 turns of 30 gage wire arranged in 18 layers and each layer including 20 turns. The cost of the EM 360 is cheaper than the cost of a rare earth magnet that will produce the same or a similar magnetic field. Additionally, the EM 360 will be smaller than a rare earth magnet that will produce the same or a similar magnetic field.

The current supply module 368 generates the current 372 to include a sinusoidal wave, triangular wave, or another suitable type of periodic signal. The current supply module 368 generates the current 372 at a predetermined frequency, such as 20 Kilo-Hertz (kHz) or another suitable frequency. The predetermined frequency may be a fixed value, or the current supply module 368 may vary the predetermined frequency, such as based on an engine speed. The current 372 may be approximately 0.2 amps on average or another suitable value.

The Hall-effect sensor 364 includes a switching-type Hall-effect sensor and generates a position signal 376 based on the magnetic field. A switching-type Hall-effect sensor transitions its output signal between first and second states based on whether the magnetic field is greater than or less than a predetermined value. For example, the Hall-effect sensor 364 may set the position signal 376 to a first state (e.g., 5 Volts) when the magnetic field is greater than a predetermined value and set the position signal 376 to a second state (e.g., 0 Volts) when the magnetic field is less than the predetermined value, or vice versa. In various implementations, a Hall-effect sensor that generates an output signal based on the magnetic field and a switching circuit that switches the position signal 376 to the first state or the second state based on the output signal may be used.

The magnetic field varies with actuation of the intake valve 118. More specifically, the magnetic field changes based on whether the intake valve 118 is closed or open. In various implementations, the magnetic field may be greater than the predetermined value when the intake valve 118 is closed, and the magnetic field may be less than the predetermined value when the intake valve 118 is open, or vice versa.

As the Hall-effect sensor 364 switches the transitions the position signal 376 between the first and second states, the position signal 376 can be said to include a pulse width modulated (PWM) signal, and the state of the position signal 376 indicates whether the intake valve 118 is closed or not closed (i.e., open). The profile of the position signal 376 varies based on whether the intake valve 118 is being operated in the low lift mode or the high lift mode. More specifically, a period that the position signal 376 is in the first state and the second state may vary based on whether the intake valve 118 is being operated in the low lift mode or the high lift mode.

Figure 4C:
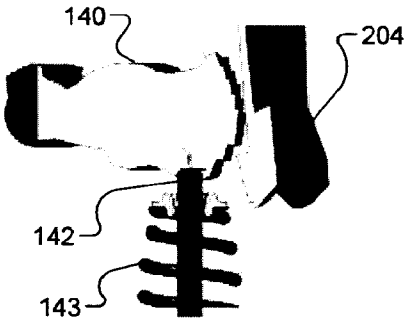
FIG. 4C is an example illustration of orientation of a position sensor when an intake valve is open to a predetermined high lift position.
Figure 4B:
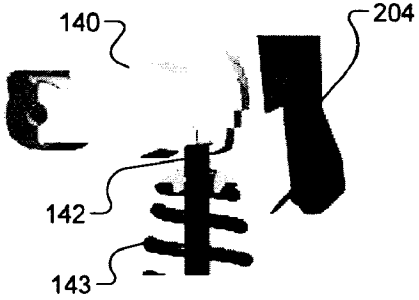
FIG. 4B is an example illustration of orientation of a position sensor when an intake valve is open to a predetermined low lift position.
Figure 4A:
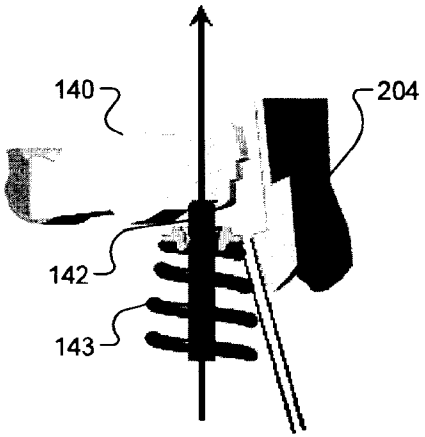
FIG. 4A is an example illustration of orientation of a position sensor when an intake valve is closed.

FIGS. 4A, 4B, and 4C are example diagrams illustrating example orientations of the position sensor 204. In FIG. 4A, the intake valve 118 is closed. In FIG. 4B, the intake valve 118 is open to the low lift position. In FIG. 4C, the intake valve 118 is open to the high lift position.

Referring to FIG. 3, a mode indicator module 380 indicates whether the VVL mechanism 136 is operating in the low lift mode or in the high lift mode based on the position signal 376. For example only, when a period that the position signal 376 is in the first state (indicating that the intake valve 118 is closed) is less than a predetermined period, the mode indicator module 380 may indicate that the VVL mechanism 136 is operating in the high lift mode. When the period that the position signal 376 is in the first state is greater than the predetermined period, the mode indicator module 380 may indicate that the VVL mechanism 136 is operating in the low lift mode. The period may begin when the position signal 376 transitions to the first state and end when the position signal 376 transitions to the second state. The period and the predetermined period may be expressed, for example, in terms of time, degrees of rotation of the crankshaft 116, or degrees of rotation of the intake camshaft 126.

In various implementations, the mode indicator module 380 may determine whether the VVL mechanism 136 is operating in the low lift mode or the high lift mode based on a period that the position signal 376 is in the second state, a ratio of the period that the position signal 376 is in the first state to the period that the position signal 376 is in the second state, or another suitable parameter. For example only, when the period that the position signal 376 is in the second state (indicating that the intake valve 118 is not closed) is less than a second predetermined period, the mode indicator module 380 may indicate that the VVL mechanism 136 is operating in the low lift mode. When the period that the position signal 376 is in the second state is greater than the second predetermined period, the mode indicator module 380 may indicate that the VVL mechanism 136 is operating in the high lift mode. For another example only, the mode indicator module 380 may indicate that the VVL mechanism 136 is operating in the high lift mode when the ratio is greater than a predetermined value and indicate that the VVL mechanism 136 is operating in the low lift mode when the ratio is less than the predetermined value, or vice versa.

The mode indicator module 380 indicates whether the VVL mechanism 136 is operating in the low lift mode or in the high lift mode via a mode signal 384. For example, the mode indicator module 380 may set the mode signal 384 to a first state when the VVL mechanism 136 is operating in the low lift mode and set the mode signal 384 to a second state when the VVL mechanism 136 is operating in the high lift mode.

A fault diagnostic module 386 may diagnose a fault in the VVL mechanism 136 based on the mode signal 384. For example only, when the mode signal 384 indicates that the VVL mechanism 136 is operating in the low lift mode for a predetermined period after the target lift mode 352 commands operation in the high lift mode, the fault diagnostic module 386 may diagnose that the VVL mechanism 136 is stuck operating in the low lift mode. When the mode signal 384 indicates that the VVL mechanism 136 is operating in the high lift mode for a predetermined period after the target lift mode 352 commands operation in the low lift mode, the fault diagnostic module 386 may diagnose that the VVL mechanism 136 is stuck operating in the high lift mode.

When a fault is diagnosed in the VVL mechanism 136, the fault diagnostic module 386 may take one or more remedial actions. For example, the fault diagnostic module 386 may illuminate a malfunction indicator lamp (MIL) 388, set a predetermined diagnostic trouble code (DTC) in a tangible computer readable medium, and/or adjust one or more engine operating parameters when a fault is diagnosed in the VVL mechanism 136. While operation of the position sensor 204 has been discussed in conjunction with the ECM 180, the current supply module 368 and the mode indicator module 380 may be implemented in another module, with the position sensor 204, or independently.

Figure 5:
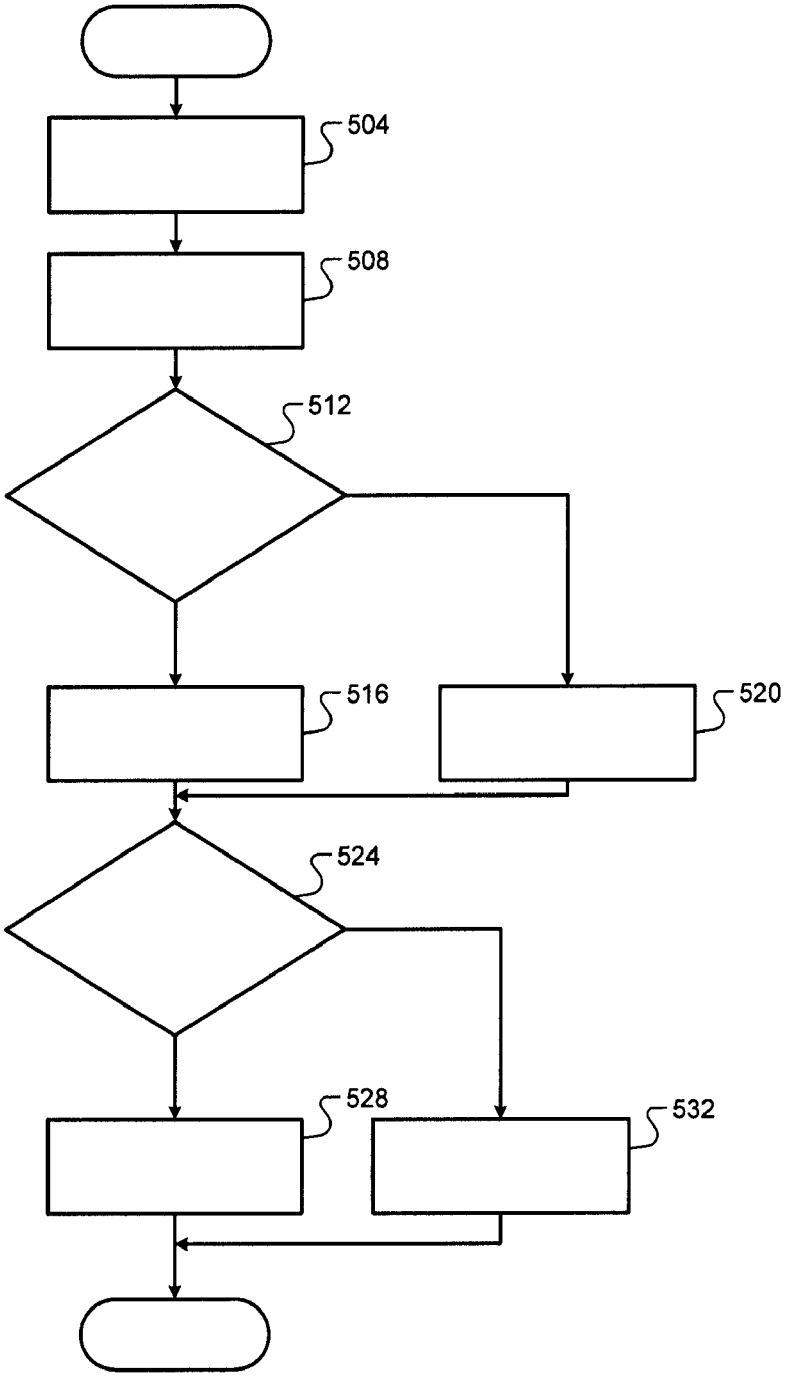
FIG. 5 is a flowchart depicting an example method for determining a mode of operation of a VVL mechanism and selectively diagnosing a fault in the VVL mechanism according to the present disclosure.

Referring now to FIG. 5, a flowchart depicting an example method for determining the mode of operation of the VVL mechanism 136 and selectively diagnosing a fault in the VVL mechanism 136 is presented. Control may begin with 504 where the current supply module 368 supplies the current 372 to the EM 360. The EM 360 generates the magnetic field proximate to a portion of the intake valve 118 based on the current 372.

At 508, the Hall-effect sensor 364 generates the position signal 376 based on whether the magnetic field is greater than or less than the predetermined value, and the mode indicator module 380 receives the position signal 376. At 512, the mode indicator module 380 may determine whether the profile of the position signal 376 is indicative the VVL mechanism 136 operating in the low lift mode. If 512 is true, the mode indicator module 380 generates the mode signal 384 to indicate that the VVL mechanism 136 is operating in the low lift mode at 516, and control continues with 524. If 512 is false, the mode indicator module 380 generates the mode signal 384 to indicate that the VVL mechanism 136 is operating in the high lift mode at 520, and control continues with 524.

The fault diagnostic module 386 may determine whether a fault is present in the VVL mechanism 136 at 524. For example, the fault diagnostic module 386 may determine that a fault is present in the VVL mechanism 136 when the mode signal 384 indicates that the VVL mechanism 136 is operating in the low lift mode a predetermined period after the valve control module 340 commands operation in the high lift mode. The fault diagnostic module 386 may additionally or alternatively determine that a fault is present in the VVL mechanism 136 when the mode signal 384 indicates that the VVL mechanism 136 is operating in the high lift mode a predetermined period after the valve control module 340 commands operation in the low lift mode. If 524 is true, the fault diagnostic module 386 indicates that a fault is present in the VVL mechanism 136 and the fault diagnostic module 386 may take one or more remedial actions at 528, and control may end. If 524 is false, the fault diagnostic module 386 may indicate that no fault is present in the VVL mechanism 136 at 532, and control may end. While control is shown and discussed as ending, FIG. 5 may be illustrative of one control loop, and control loops may be performed at a predetermined rate.

The foregoing description is merely illustrative in nature and is in no way intended to limit the disclosure, its application, or uses. The broad teachings of the disclosure can be implemented in a variety of forms. Therefore, while this disclosure includes particular examples, the true scope of the disclosure should not be so limited since other modifications will become apparent upon a study of the drawings, the specification, and the following claims. For purposes of clarity, the same reference numbers will be used in the drawings to identify similar elements. As used herein, the phrase at least one of A, B, and C should be construed to mean a logical (A or B or C), using a non-exclusive logical OR. It should be understood that one or more steps within a method may be executed in different order (or concurrently) without altering the principles of the present disclosure.

In this application, including the definitions below, the term module may be replaced with the term circuit. The term module may refer to, be part of, or include an Application Specific Integrated Circuit (ASIC); a digital, analog, or mixed analog/digital discrete circuit; a digital, analog, or mixed analog/digital integrated circuit; a combinational logic circuit; a field programmable gate array (FPGA); a processor (shared, dedicated, or group) that executes code; memory (shared, dedicated, or group) that stores code executed by a processor; other suitable hardware components that provide the described functionality; or a combination of some or all of the above, such as in a system-on-chip.

The term code, as used above, may include software, firmware, and/or microcode, and may refer to programs, routines, functions, classes, and/or objects. The term shared processor encompasses a single processor that executes some or all code from multiple modules. The term group processor encompasses a processor that, in combination with additional processors, executes some or all code from one or more modules. The term shared memory encompasses a single memory that stores some or all code from multiple modules. The term group memory encompasses a memory that, in combination with additional memories, stores some or all code from one or more modules. The term memory may be a subset of the term computer-readable medium. The term computer-readable medium does not encompass transitory electrical and electro-magnetic signals propagating through a medium, and may therefore be considered tangible and non-transitory. Non-limiting examples of a non-transitory tangible computer readable medium include nonvolatile memory, volatile memory, magnetic storage, and optical storage.

The apparatuses and methods described in this application may be partially or fully implemented by one or more computer programs executed by one or more processors. The computer programs include processor-executable instructions that are stored on at least one non-transitory tangible computer readable medium. The computer programs may also include and/or rely on stored data.

What is claimed is:

1. A system for a vehicle, comprising:

a position sensor that includes:

an electromagnet (EM) that generates a magnetic field proximate to one of an intake valve and an exhaust valve of an engine; and a Hall-effect sensor that generates a position signal indicating a position of the one of the intake valve and the exhaust valve based on the magnetic field;

a current supply module that supplies current to the EM according to a repeating periodic pattern, independently of feedback from the Hall-effect sensor; and a mode indicator module that indicates whether the one of the intake valve and the exhaust valve is being actuated in a low lift mode or a high lift mode based on the position signal.

2. The system of claim 1 wherein the Hall-effect sensor transitions the position signal from a first state to a second state when the magnetic field is greater than a predetermined value and transitions the position signal from the second state to the first state when the magnetic field is less than the predetermined value.

3. The system of claim 2 wherein the mode indicator module indicates whether the one of the intake valve and the exhaust valve is being actuated in the low lift mode or the high lift mode based on whether a period that the position signal is in the first state is greater than a predetermined period.

4. The system of claim 2 wherein the mode indicator module indicates whether the one of the intake valve and the exhaust valve is being actuated in the low lift mode or the high lift mode based on whether a period that the position signal is in the first state is less than a predetermined period.

5. The system of claim 2 wherein the mode indicator module indicates whether the one of the intake valve and the exhaust valve is being actuated in the low lift mode or the high lift mode based on whether a period that the position signal is in the second state is greater than a predetermined period.

6. The system of claim 2 wherein the mode indicator module indicates whether the one of the intake valve and the exhaust valve is being actuated in the low lift mode or the high lift mode based on whether a period that the position signal is in the second state is less than a predetermined period.

7. The system of claim 1 further comprising a fault diagnostic module that selectively diagnoses a fault in a variable valve lift (VVL) mechanism of the one of the intake valve and the exhaust valve based on the indication of whether the one of the intake valve and the exhaust valve is being actuated in the low lift mode or the high lift mode.

8. The system of claim 7 further comprising:

a valve control module that selectively commands actuation of the one of the intake valve and the exhaust valve in the low lift mode based on a torque request, wherein the fault diagnostic module diagnoses a fault in the VVL mechanism when the mode indicator module indicates that the one of the intake valve and the exhaust valve is being actuated in the high lift mode a predetermined period after generation of the command.

9. The system of claim 7 further comprising:

a valve control module that selectively commands actuation of the one of the intake valve and the exhaust valve in the high lift mode based on a torque request, wherein the fault diagnostic module diagnoses a fault in the WL mechanism when the mode indicator module indicates that the one of the intake valve and the exhaust valve is being actuated in the low lift mode a predetermined period after generation of the command.

10. The system of claim 1 wherein the repeating periodic pattern includes one of a sinusoidal wave and a triangular wave.

11. A method for a vehicle, comprising:

generating, using an electromagnet (EM) of a position sensor, a magnetic field proximate to one of an intake valve and an exhaust valve of an engine;

generating, using a Hall-effect sensor of the position sensor, a position signal indicating a position of the one of the intake valve and the exhaust valve based on the magnetic field;

supplying current to the EM according to a repeating periodic pattern, independently of feedback from the Hall-effect sensor; and indicating whether the one of the intake valve and the exhaust valve is being actuated in a low lift mode or a high lift mode based on the position signal.

12. The method of claim 11 further comprising:

transitioning, using the Hall-effect sensor, the position signal from a first state to a second state when the magnetic field is greater than a predetermined value; and transitioning, using the Hall-effect sensor, the position signal from the second state to the first state when the magnetic field is less than the predetermined value.

13. The method of claim 12 further comprising indicating whether the one of the intake valve and the exhaust valve is being actuated in the low lift mode or the high lift mode based on whether a period that the position signal is in the first state is greater than a predetermined period.

14. The method of claim 12 further comprising indicating whether the one of the intake valve and the exhaust valve is being actuated in the low lift mode or the high lift mode based on whether a period that the position signal is in the first state is less than a predetermined period.

15. The method of claim 12 further comprising indicating whether the one of the intake valve and the exhaust valve is being actuated in the low lift mode or the high lift mode based on whether a period that the position signal is in the second state is greater than a predetermined period.

16. The method of claim 12 further comprising indicating whether the one of the intake valve and the exhaust valve is being actuated in the low lift mode or the high lift mode based on whether a period that the position signal is in the second state is less than a predetermined period.

17. The method of claim 11 further comprising selectively diagnosing a fault in a variable valve lift (VVL) mechanism of the one of the intake valve and the exhaust valve based on the indication of whether the one of the intake valve and the exhaust valve is being actuated in the low lift mode or the high lift mode.

18. The method of claim 16 further comprising:

selectively commanding actuation of the one of the intake valve and the exhaust valve in the low lift mode based on a torque request; and diagnosing a fault in the VVL mechanism when the one of the intake valve and the exhaust valve is being actuated in the high lift mode a predetermined period after generation of the command.

19. The method of claim 17 further comprising:

selectively commanding actuation of the one of the intake valve and the exhaust valve in the high lift mode based on a torque request; and diagnosing a fault in the VVL mechanism when the one of the intake valve and the exhaust valve is being actuated in the low lift mode a predetermined period after generation of the command.

20. The method of claim 11 wherein the repeating periodic pattern includes one of a sinusoidal wave and a triangular wave.

* * * * *